United States Patent [19]

Anderson et al.

[11] Patent Number: 4,542,583

[45] Date of Patent: Sep. 24, 1985

[54] COMPRESSION HAND TOOL

[75] Inventors: James D. Anderson, Norwalk; Patrick Crossin, Fairfield, both of Conn.

[73] Assignee: Burndy Corporation, Norwalk, Conn.

[21] Appl. No.: 704,156

[22] Filed: Feb. 22, 1985

Related U.S. Application Data

[63] Continuation of Ser. No. 305,317, Sep. 24, 1981, abandoned.

[51] Int. Cl.[4] ..... H01R 43/00

[52] U.S. Cl. ..... 29/749; 29/268; 29/747; 29/751; 72/409; 72/466; 81/353; 81/363; 81/420

[58] Field of Search ..... 29/749, 751, 758, 747, 29/268; 72/410, 409, 466, 433, 434; 81/352-363, 420-427; 269/258

[56] References Cited

U.S. PATENT DOCUMENTS

| | | | |
|---|---|---|---|
| 1,728,631 | 9/1929 | Sandoz | 81/353 X |
| 2,538,159 | 1/1951 | Maeser et al. | 72/434 |
| 2,613,567 | 10/1952 | Tenerowicz et al. | 81/356 |
| 2,892,368 | 6/1959 | Demler | 81/15 |
| 3,133,461 | 5/1964 | Walton | 81/361 X |
| 3,267,717 | 8/1966 | Reischer | 72/416 |
| 3,406,558 | 10/1968 | Tillmann et al. | 72/416 |
| 4,174,560 | 11/1970 | Senior et al. | 29/751 X |
| 4,240,280 | 12/1980 | Foslien | 72/410 |
| 4,299,146 | 11/1981 | Phelps | 81/420 |

FOREIGN PATENT DOCUMENTS

| | | | |
|---|---|---|---|
| 717900 | 1/1932 | France | 72/434 |

*Primary Examiner*—Carl E. Hall

*Attorney, Agent, or Firm*—Howard S. Reiter

[57] ABSTRACT

A crimping tool of the type employed in crimping or compressing an article such as an electrical connector which has a substantially fixed jaw which has a surface against which an article is compressed, a ram having a surface for supporting a die and an article, the ram being mounted for movement toward and away from the jaw, and a die holder which is pivotally mounted to the ram to keep the compressing surface of the jaw and the supporting surface of the ram parallel throughout the movement of the ram in the event that the jaw deflects slightly during operation of the tool.

11 Claims, 2 Drawing Figures

COMPRESSION HAND TOOL

This is a continuation of co-pending application Ser. No. 305,317, filed on Sept. 24, 1981, now abandoned.

BACKGROUND OF THE INVENTION

This invention is directed to a crimping tool of the type used for crimping a small article such as an electrical connector, and more particularly to a crimping tool which is a portable hand tool.

U.S. Pat. Nos. 3,267,717 and 3,406,558 show typical examples of tools used for crimping electrical connectors. One of the tools shown is portable, but the other is not. A problem in prior art crimping tools is that because of the high crimping pressures involved, the load bearing surface of the jaw of the tool tends to deflect the jaw during operation of the tool. Such deflection produces a non-uniform pressure across the surface of the electrical connector resulting in defective crimps and thus defective connections between the connector and the wires to which the connector is being crimped.

The application of uniform pressure is particularly important when an electrical connector is being crimped to a ribbon-type conductor. A ribbon-type conductor is a unitary structure containing a plurality of parallel conductors or wires surrounded by and separated from each other by insulation. When an electrical connector is crimped to a ribbon-type conductor, the blades within the electrical connector cut through the insulation around each of the conductors and make contact with the conductors. If uniform pressure is not applied across the surface of the electrical connector during the crimping operation, some of the contact between the blades and the conductors may not be complete, and thus there can be no current flow between the blades and these conductors after the crimping operation is completed.

One solution to this problem has been to substantially increase the size and weight of the tool to increase its resistance to deflection. Although this solution may not be a serious problem in a non-portable power driven tool, it is in a portable hand tool.

SUMMARY OF THE INVENTION

To overcome the above prior art problem, a primary object of the present invention is to minimize the size and weight of a crimping tool while enabling the tool to maintain substantially uniform pressure over the surface of the electrical connector being crimped so that a perfect connection is made between each of the blades in the electrical connector and the conductor to which it is connected. To effect this, the crimping tool has a substantially fixed jaw which has a surface against which the electrical connector is compressed. A ram having a surface for supporting a die and the electrical connector to be compressed is mounted for movement toward and away from the jaw to effect the compression. The conductor is positioned between the die and the electrical connector during the crimping operation. To drive the ram, a piston is pivotally connected thereto to keep the supporting surface of the ram parallel to the compressing surface of the jaw whereby uniform pressure is applied across a surface of the connector as the latter is compressed.

DETAILED DESCRIPTION OF THE INVENTION

Figure 1:
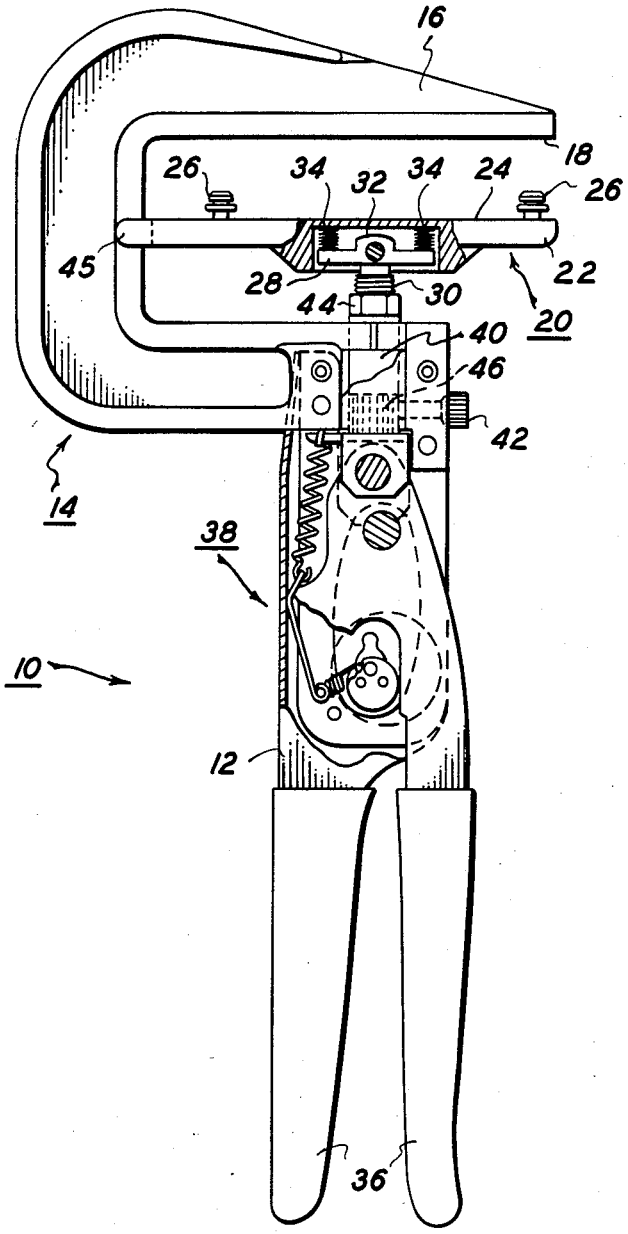
FIG. 1 is a front vertical sectional view of a crimping tool constructed in accordance with the present invention.
Figure 2:
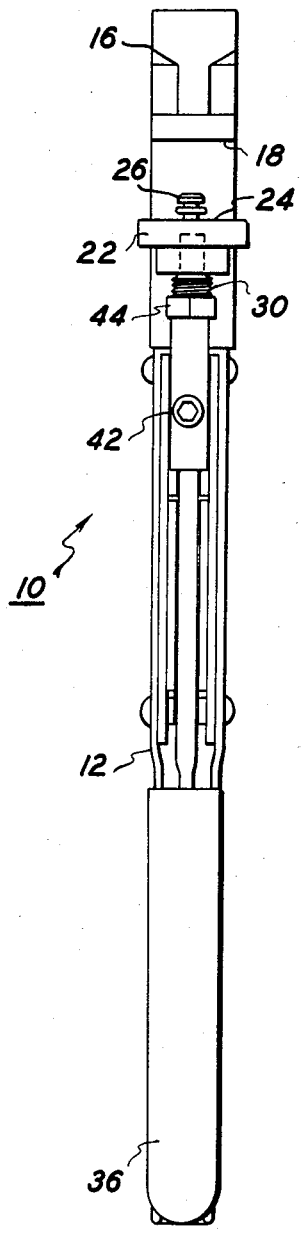
FIG. 2 is a side view of the tool shown in FIG. 1.

Referring more particularly to the drawings, a crimping tool 10 constructed according to the present invention has a body 12 to which is connected a suitably shaped member, such as C-shaped member 14. The member defines a substantially fixed jaw 16, the latter having a surface 18 against which the article, such as an electrical connector, is compressed. Although the jaw 16 is substantially fixed, it is of a size and weight which allows it to be deflected slightly during operation of the tool 10.

To support a suitable die (not shown) which, in turn, supports the article to be compressed (such as a ribbon-type insulation displacement conductor), ram 20 is mounted for movement toward and away from the jaw 16. The ram has die holder 22 which has a surface 24 for supporting the die. Locating lugs 26, adapted to locate the die on the surface 24, are also provided. These lugs serve to retain the die in position during operation of the tool. Dies adapted to accommodate different sizes of electrical connectors and ribbon-type conductors can be used with the present tool.

Ram 20 also includes a second member, such as cross bar 28, which is pivotally connected to die holder 22 by any suitable means, such as pin 32, which extends through both members 22 and 28. Suitable biasing means, such as springs 34 on each side of pin 32, serve to keep die holder 22 parallel to surface 18 when in the non-loaded state. With this arrangement, as cross bar 28, and consequently ram 20, are being moved upwardly to compress an article against compressing surface 18; surfaces 18 and 24 are always maintained substantially parallel to each other even if the jaw 16 is slightly deflected. This assures that uniform pressure is applied across the surface of the article being compressed during the entire crimping operation. Member 22 can be, but need not necessarily be, guided on member 14 throughout its travel. This is accomplished in the embodiment shown in the drawings by means of two tangs 45. The tangs keep die holder 22 aligned to member 14 in the direction perpendicular to the plane of the drawing.

To move cross bar 28 upwardly, an operating handle 36 is moved in the direction of the arrow causing member 28 to move via an actuating and retraction mechanism 38. As the handle is released, mechanism 38 causes the handle to move in the opposite direction and the ram 20 to return to its original starting position. To control the length of travel of the ram 20 and the force applied to the article to be compressed, an internally threaded piston 40 and lock screw 42 are used to vary the adjustable position of cross member 28 and, consequently, that of the ram 20. The adjustable feature enables many different combinations of connectors and dies to be used, each having its particular compression height and force.

To set up the tool 10 for operation on a particular electrical connector and a particular ribbon-type conductor, lock screw 42 is loosened and nut 44, which is an integral part of piston 40, is rotated left or right to allow cross bar 28 to be positioned. Since the external threads of member 28 are engaged into the internal threads of piston 40, the rotation of nut 44 (a part of 40) causes cross bar 28 to be adjustably extended or shortened. Lock screw 42 is then tightened so that its end engages one of the grooves 46, in piston 40, thus preventing piston 40 from further rotation but allowing it to advance and retract. The arrangement enables the ram adjusting mechanism to be locked to prevent unintentional adjustment while still leaving the ram free to move toward and away from the jaw for the crimping action. A particular die is then positioned on the supporting surface 24 of member 22, a ribbon-type conductor is placed on the die with its associated electrical connector located in place on the conductor for installation. To install the electrical connector onto the ribbon-type conductor, the handle 36 is moved in the direction of the arrow to move the ram upwardly. This action compresses the connector onto the conductor between the die and surface 18 of jaw 16.

During this compression operation, jaw 16 may tend to deflect upwardly slightly. As soon as this begins to occur, however, member 22 pivots to always maintain supporting surface 24 substantially parallel to compressing surface 18. This action assures uniform pressure over the entire surface of the electrical connector and ribbon-type conductor. The uniform pressure provides perfect connections between all of the blades in the electrical connector and all of the conductors or wires within the unitary ribbontype conductor. Handle 36 is then released and it is returned to its original position by mechanism 38.

It should be understood that the foregoing description is only illustrative of the invention. Various alternatives and modifications in the structural and functional features of the Compression Hand Tool can be devised by those skilled in the art without departing from the invention. Accordingly, the present invention is intended to embrace all such alternatives, modifications and variations and fall within the spirit and scope of the appended claims.

What is claimed is:

1. A crimping tool for compressing an article comprising:

a. member means defining a substantially fixed jaw having a surface against which the article is compressed;

b. a ram having a surface for supporting a die and the article to be compressed, the ram being mounted for movement toward and away from the jaw and having tang means for engaging said member means, said tang means serving to maintain said ram in alignment with said member means;

c. drive means for moving said ram toward and away from said jaw, comprising: a piston means and means for connecting the piston means to the ram for pivotal movement about a first axis; and d. means for keeping the supporting surface of the ram substantially parallel to the compressing surface of the jaw in the event that the jaw pivotally deflects slightly about the first axis during operation of the tool whereby said tang means serves to maintain an alignment of said ram with said member means and said ram is maintained substantially parallel to said compressing surface of said compressing surface of said jaw thereby applying uniform pressure to the article as the article is compressed.

2. A crimping tool as set forth in claim 1 wherein the ram comprises a first member which contains the supporting surface, a second member which is pivotally connected to the first member and biasing means between the first member and the second member on each side of where the second member is pivotally connected to the first member.

3. A crimping tool as set forth in claim 1 in which the ram is guided by the means defining the substantially fixed jaw.

4. A crimping tool as set forth in claim 1, and further including means for adjusting the position of the ram relative to the jaw.

5. A crimping tool as set forth in claim 1 which further includes an operating handle for moving the ram toward the jaw.

6. A crimping tool as set forth in claim 4 having means to adjust the relative position of the ram to the jaw so that different combinations of connectors and dies can be compressed to their particular height and force.

7. A crimping tool as set forth in claim 4 having means to lock the ram adjustment so as to prevent unintentional adjustment thereof while leaving the ram free to move toward and away from the jaw.

8. A crimping tool for compressing together a ribbon-type conductor and an associated electrical connector to make intimate contact between a plurality of blades in the connector and a plurality of parallel wires in the conductor, the tool comprising:

a. member means defining a substantially fixed jaw having a surface against which the electrical connector is compressed, said jaw being deflectable by pivotal movement about a first axis during operation;

b. a ram mounted for movement toward and away from the jaw, the ram having a surface for supporting a die which die in turn supports the electrical connector and the ribbon-type conductor positioned between the electrical connector and the die, the ram having a first member which contains the supporting surface, and a second member, said ram also having tang means for engaging said member means, said tang means serving to maintain said ram in alignment with said member means;

c. means, including a piston connected to second member for pivotal movement about an axis parallel to the first axis and biasing means extending between the first and second members on each side of where the first member is pivotally connected to the second member, for keeping the supporting surface of the ram parallel to the compressing surface of the jaw in the event that the jaw deflects during the compression operation of the tool whereby uniform pressure is applied across the surface of the electrical connector and ribbon-type conductor during the compression operation, said uniform pressure providing relatively perfect connections between the blades in the electrical connector and the respective conductors in the ribbon-type conductor.

9. A crimping tool as set forth in claim 8 having means to accommodate various dies so that various sizes of electrical connectors and ribbon-type conductors can be compressed together.

10. A crimping tool as set forth in claim 8 wherein said biasing means includes two separate springs.

11. A crimping tool for compressing together a ribbon-type conductor and an associated electrical connector to make intimate contact between a plurality of blades in the connector and a plurality of parallel wires in the conductor, the tool comprising:

a. member means having a relatively small size and weight defining a substantially fixed jaw having a surface against which the electrical connector is compressed, said jaw being deflectable by pivotal movement about a first axis during operation;

b. a ram mounted for movement toward and away from the jaw, the ram having a surface for supporting a die which die in turn supports the electrical connector and the ribbon-type conductor positioned between the electrical connector and the die, the ram having a first member which contains the supporting surface, and a second member, said ram also having tang means for engaging said member means, said tang means serving to maintain said ram in alignment with said member means;

c. means to control the length of movement of said ram and the force applied to the connector; and d. means, including a piston connected to the second member for pivotal movement about an axis parallel to the first axis and biasing means extending between the first and second members on each side of where the first member is pivotally connected to the second member, for keeping the supporting surface of the ram parallel to the compressing surface of the jaw in the event that the jaw deflects during the compression operation of the tool whereby uniform pressure is applied across the surfaces of the electrical connector and ribbon-type conductor during the compression operation, said uniform pressure providing relatively perfect connections between the blades in the electrical connector and the respective conductors in the ribbon-type conductor.

* * * * *